United States Patent [19]

Trammel

[11] Patent Number: 4,734,179

[45] Date of Patent: Mar. 29, 1988

[54] BULLET PLATING CAROUSEL

[76] Inventor: Gary L. Trammel, 5540 Walnut Ave., Long Beach, Calif. 90805

[21] Appl. No.: 939,444

[22] Filed: Nov. 21, 1986

[51] Int. Cl.[4] ..... C25D 17/06

[52] U.S. Cl. ..... 204/199; 204/222; 204/297 W

[58] Field of Search ..... 204/199, 212, 221, 222, 204/297 W, 261, 25; 29/1.23

[56] References Cited

U.S. PATENT DOCUMENTS

| | | | |
|---|---|---|---|
| 351,576 | 10/1886 | Cassel | 204/261 |
| 893,472 | 7/1908 | Forget | 204/261 |
| 1,544,227 | 6/1925 | Dodge | 204/212 |
| 2,502,495 | 4/1950 | Waterman | 204/25 |
| 2,523,973 | 9/1950 | Snyder | 204/297 W |
| 3,349,711 | 10/1967 | Darigo et al. | 29/1.23 |
| 3,431,612 | 3/1969 | Darigo et al. | 29/1.23 |
| 4,194,957 | 3/1980 | Lipschutz | 204/199 |
| 4,639,302 | 1/1987 | Everett | 204/258 |

*Primary Examiner*—John F. Niebling
*Assistant Examiner*—Steven P. Marquis
*Attorney, Agent, or Firm*—Charles H. Thomas

[57] ABSTRACT

A convenient, easily operated bullet jacketing machine for the ammunition reloader. It is most commonly used to copper plate cast or swaged lead alloy bullet cores. All mechanical and electrical components necessary for the electroplating process (excluding power source) are assembled into or installed onto a carousel unit. Anodes and cathode holders (workpiece stations) are located in alternating sequence around the periphery of the carousel; each workpiece being accurately positioned between (but not touching) two anodes. The carousel unit is suspended in an electroconductive plating bath by a shaft passing through and fixed to its axis. This axial shaft also provides a means to pivot the carousel back and forth during operation, thereby agitating the plating bath around the anodes and cathodes. This manner of agitation uniformly increases the metal transfer efficiency of the plating bath as direct current (DC) electricity is passed from the bullet cores (−), through the electroconductive bath to the anodes (+). The plating metal flows in the opposite direction, and is deposited on the surfaces of the bullet cores. After plating, the finished bullets can be lubricated and die sized in preparation for shooting.

3 Claims, 1 Drawing Figure

BULLET PLATING CAROUSEL

BACKGROUND OF THE INVENTION

A. Field of the Invention

Figure 1:
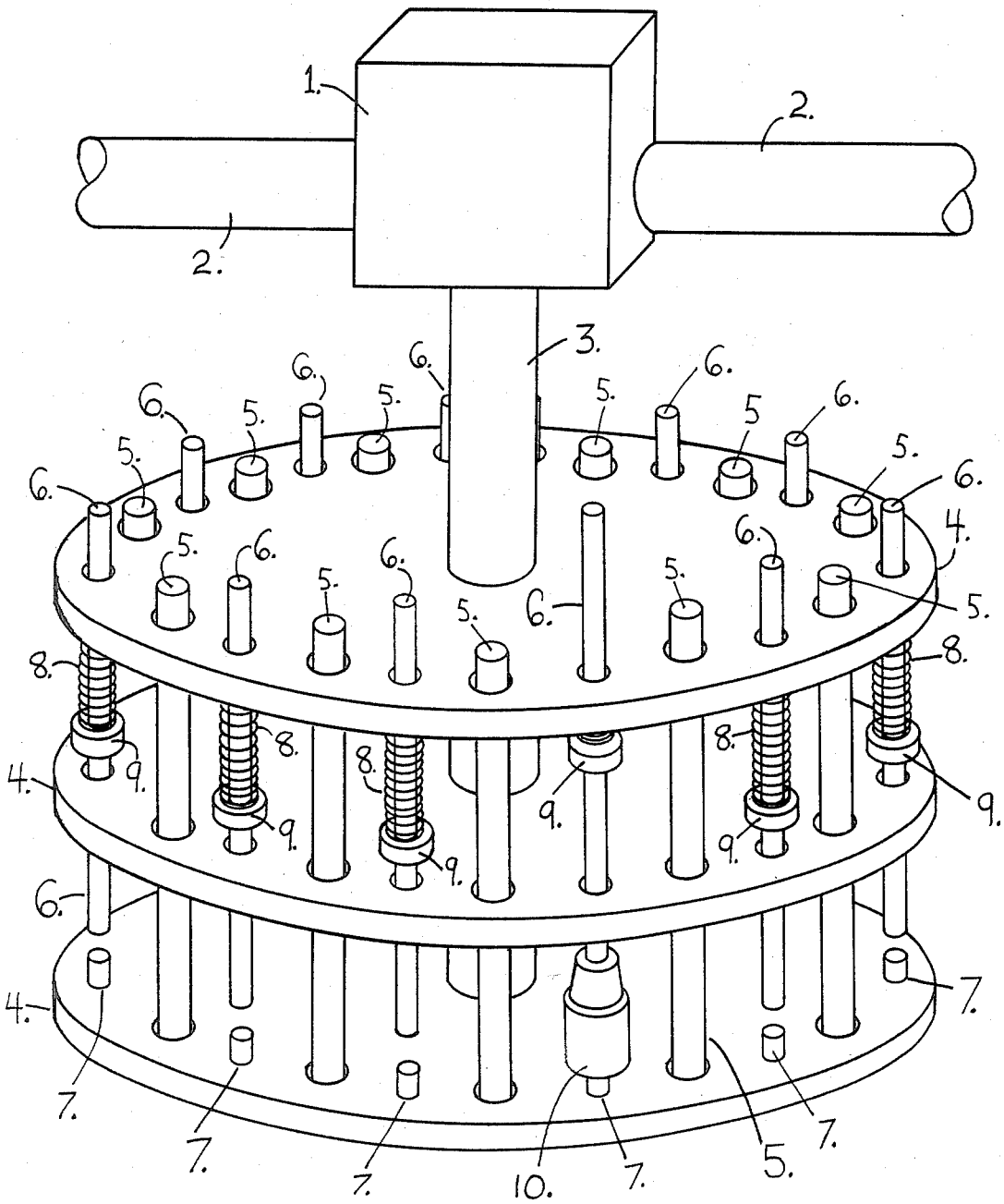

Metal (usually copper or gilding metal) jacketed bullets are extensively used for high velocity handgun and rifle shooting. This protective jacket is much harder and stronger than the heavy lead alloy bullet core, but much softer than a gun's steel barrel. This yields high performance potential without excessive barrel wear. The Bullet Plating Carousel is used to apply protective jackets (usually copper) to cast or swaged lead alloy bullet cores.

B. Description of Prior Art

Plain, uncoated lead alloy bullets are used extensively in low velocity shooting applications. But as velocity requirements increase, so do problems with plain lead alloy bullets. To eliminate bullet deformation and lead fouling in gun barrels, and the inaccuracy in shooting that results, some type of protective coating on a lead alloy bullet is desirable. This protective coating has taken the form of lubricants, lacquers, paper patching, cloth patching, plastic jacketing and various types of metal jacketing. Nowadays, most bullet jackets are drawn copper or gilding metal, assembled to their lead cores by swaging. Electroplating is used to some extent by commercial ammunition factories in low performance applications such as 0.22 rimfire bullets, and copper plated shotgun pellets. These coatings are applied to large quantities of projectiles by the barrel plating process. The Bullet Plating Carousel is the easiest, safest, most economical system to use for applying precision, high performance jackets to small batches of cast or swaged lead alloy bullet cores in a non-industrial setting.

SUMMARY

The Bullet Plating Carousel is a compact, easy to use tool that may be used by the average handloading shooter to economically produce accurate, jacketed projectiles for high velocity hunting and target shooting. It may also be used to electroplate other types of small objects.

DRAWING

The drawing is about ⅔ scale of current prototypes of the Bullet Plating Carousel. FIG. 1 is a perspective view of the machine showing the motorized agitator (1), crossbar (2) or frame member (2), carousel mounting shaft (3), carousel plates (4), anodes (5), cathode pins (6), riser pins (7), coil springs (8), collars (9) and a bullet core (10) positioned for plating. Mechanical components and wiring not considered to be part of the invention have been excluded from the drawing for simplicity.

DESCRIPTION

The Bullet Plating Carousel is a unique machine that began development in my shop in early 1982, and is the subject of DISCLOSURE DOCUMENT No. 133902 in the Office of Patents and Trademarks, dated Jan. 9, 1985. Its function is to economically and efficiently electroplate jackets onto cast or swaged lead alloy bullet cores (10) to increase their performance potential. It can also be used to electroplate small objects such as jewelry, machine parts, etc.

Current specimens of the Bullet Plating Carousel are built with 9½ inch diameter carousel plates (4). This allows standard five gallon plastic pails to be used for electrocleaning, rinsing and plating. The 9½ inch diameter carousel easily accomodates twelve ¼ inch diameter anodes (5) installed in holes evenly spaced around the peripheral edge of the carousel plates (4). A cathode (bullet) station is located between the anodes (5), giving twelve bullet cores (10) uniform electrical exposure to those anodes (5). The aforementioned carousel dimensions are used for convenience, but Bullet Plating Carousels have been built in several smaller and larger sizes. Any size, with any number of anode and cathode stations could be constructed to fulfill a specific need. Extra plates can be added to the carousel to provide extra rows of plating stations below the first row. Stacking the plating stations in this manner allows more bullet cores to be plated on a carousel of a given diameter. This increases the efficiency of space and materials.

Carousel plates (4) can be constructed of most any rigid material that will withstand mild acid and alkaline solutions. Polypropylene, polystyrene and acrylic plastics have all been successfully employed as carousel plate materials. Metal plates can be used, but tend to corrode and attract undesirable electrodeposits unless thoroughly insulated from all anodes (5) and cathodes (6) (10). Non-metallic, non-electrically conductive materials are most practical for the construction of carousel plates and other structural components subject to submersion in the corrosive plating bath.

Existing working modes of the Bullet Plating Carousel are constructed with three 9½ inch diameter, ¼ inch thick polypropylene plates. A one inch diameter nylon rod (3) passes through the center axis of each plate (4) and extends several inches above the uppermost plate to serve as a mounting shaft (3) for the carousel unit. Tubular plastic collars are slipped over the nylon rod (3) between plates (4) to space the axially aligned plates two inches apart. All plates (4) are mechanically keyed to the nylon rod (3) to prevent any movement or misalignment.

Twelve anodes (5) are installed in evenly spaced holes around the peripheral edge of the carousel, passing through all three plates (4). Anodes (5) can be soluble rods of the metal to be deposited by electroplating (usually copper) or insoluble rods (usually stainless steel).

Twelve electroconductive cathode pins (6) are installed in evenly spaced holes around the peripheral edge of the carousel, located between (but not touching) the anodes (5). The cathode pins (6) pass through the two upper carousel plates (4). A coil spring (8) installed on each cathode pin (6) bears on the uppermost plate, and on a collar (9) affixed to the cathode pin itself by a set screw. This spring-loads the cathode pins downward, but allows upward movement of the pin (6) by compressing the spring (8). Twelve riser pins (7) are installed into the lower carousel plate directly below each spring-loaded cathode pin. A bullet station is comprised of a cathode pin (6) and a riser pin (7). A bullet core (10) to be plated is placed between the riser pin and the cathode pin, held in place by spring loading. The first prototypes of the Bullet Plating Carousel were built with only two carousel plates, and bullet cores were held in place by the tension of fixed wire cathode pins.

Bullet cores and anodes are arranged in alternating sequence around the periphery of the carousel. So placed, all bullet cores receive uniform electrical exposure to the anodes. Uniformity in anode/cathode exposure is very important when precision electrodeposition of metal is necessary. Using circular plates as the basis of construction of the carousel is both convenient and practical, but any physical structure which would hold anodes and cathodes in the alternating sequence described above would also work well.

Low voltage direct current (DC) for electroplating is brought from a battery, generator or rectifier to the anodes and cathodes by standard electrical wiring. In this application, 6 or 12 volt automotive power sources work well. Anodes are connected to the positive (+) pole of the power source. Cathodes are connected to the negative (−) pole. So wired, the carousel is placed into a plating bath so as to submerge the bullet cores and anodes.

The plating bath can be one of several different chemical formulas, depending on the type and quality of metal deposit needed, and the ease of bath maintenance desired. For most bullet jacketing applications, a simple acid/copper solution of 5 pounds copper sulfate, 1 pint sulfuric acid and 4 gallons of water makes an inexpensive, serviceable bath that requires almost no maintenance.

Once the carousel is positoned in the plating bath with bullet cores and anodes submerged, electroplating can commence. When electrical power is connected, the current flows from the bullet cores, through the electroconductive plating bath to the anodes. The plating metal flows in the opposite direction and is deposited on the bullet cores in a smooth, solid layer.

The plating bath supplies the metal for deposition. Anodes of the soluble type dissolve as electroplating progresses, thereby continuously replenishing the suspended metal in the bath. When insoluble anodes are used, the bath will eventually become depleted or suspended metal, and will need replenishment of its meal bearing constituent. In an acid/copper bath, more copper sulfate would be added.

When plating at high amperage to achieve high metal deposition rates, the bath immediately adjacent to the cathodes (bullet cores) is very quickly depleted of suspended metal. This condition can "starve" the workpieces for available plating metal. Therefore, it is desirable to achieve good circulation of the bath during use to ensure adequate quantities of available suspended metal. There are several ways to do this, but the Bullet Plating Carousel is designed to make use of a motorized agitator (1) that rotationally reciprocates the carousel clockwise to counterclockwise continuously while electroplating. This mode of agitation is extremely efficient, and dispenses with the problems associated with pump-circulating the bath itself. Using the carousel as a fixture to plate bullet cores without agitation works well if plating amperage is kept low enough. This mode is much slower in depositing a given amount of electroplate.

The motorized agitator (1) is mounted on a supporting crossbar (2) or frame member (2), and serves as a mounting point for the 1 inch diameter nylon rod (3) that passes through the center of the carousel plates (4). Mounted in this way, the 9½ inch diameter carousel can be suspended at the proper height to utilize a five gallon plastic pail as a plating tank. The support crossbar (2) or frame member (2) can be stationary, movable or free-standing. Current prototypes are constructed with free-standing support frames.

Plating a batch of bullet cores follows the following sequence:

(a) The bullet cores are positioned in their stations, retained by the spring tension of the cathode pins (6).

(b) The carousel (with bullet cores) is put into a tank of alkaline electrocleaning solution. Direct current electrical power is connected and allowed to flow through the solution between the bullet cores and a separate electrocleaning anode. Plating anodes are usually not used for electrocleaning. A few seconds of electrocleaning will prepare the surfaces of the bullet cores for plating. The electric current is disconnected, and the carousel is removed from the electrocleaning tank.

(c) The carousel and bullet cores are rinsed with clean water.

(d) The carousel is then placed into the plating tank. The agitator (1) is started first to ensure good bath circulation. The plating current is then connected. As current flows through the bath, the bullet cores are uniformly jacketed with plating metal. When the desired jacket thickness has been attained, the plating current is disconnected and the agitator turned off. The carousel is then removed from the plating tank.

(e) The carousel and finished bullets are rinsed with clean water.

(f) The jacketed bullets are removed from their stations and allowed to dry. They are then lubed and die sized to prepare them for loading and shooting.

The bullets produced by this process differ considerably from conventional jacketed bullets, and yield performance characteristics unobtainable with any other type of bullet. By varying the design and alloy composition of the core, and the thickness of the electroplated jacket, a handloader can produce bullets with almost infinite performance diversity. Projectiles can be precisely tailormade for each shooting task.

The Bullet Plating Carousel will be manufactured and marketed nationwide for the benefit of interested law enforcement agencies, hunters and sport shooters. Certain small parts manufcturers and jewelers might also find good use for this machine.

I claim the following:

1. A machine for jacketing bullet cores with electroplated metal, comprising a carousel, a motorized agitator and a supporting frame, said carousel including at least two parallel non-electrically conductive plates spaced apart and affixed to a rod passing through the centers of said plates, anodes spaced apart and mounted around the peripheral edge of said carousel, cathode pins and riser pins in line with each other and located around the peripheral edge of said carousel between but not touching said anodes, said bullet cores being placed between and contacting said cathode pins and said riser pins, said bullet cores being held in place by said cathode pins and said riser pins, said motorized agitator being attached to said supporting frame and connected to said rod, thereby suspending said carousel in an electroplating bath, said carousel being continuously reciprocated clockwise to counterclockwise in said electroplating bath by said motorized agitator to effect circulation of said bath to increase the efficiency of metal electrodeposition onto said bullet cores when direct current electricity is conducted from said bullet cores through said electroplating bath to said anodes.

2. A rotationally reciprocating carousel for electroplating bullet cores, said carousel being suspended by a crossbar or frame so as to be properly positioned in a plating bath, said carousel being comprised of two or more plates that are axially aligned and parallel to each other, said plates being spaced apart and structurally fixed in the aforementioned attitude, means supported relative to said frame and coupled to continuously and rotationally reciprocate said carousel in clockwise and counterclockwise directions during electroplating, anodes spaced apart and installed around the periphery of said carousel, cathode stations located between but not contacting said anodes at the periphery of said carousel, said cathode stations holding the said bullet cores in a relationship of alternating sequence with said anodes to give uniform electrical exposure of said anodes to said bullet cores, the reciprocating action of said carousel effecting circulation of the said plating bath during the electroplating process.

3. A machine for electroplating jackets onto bullet cores, comprised of a frame, a carousel and a motorized agitator, said frame serving to suspend said carousel in a plating bath, said carousel being a structure that holds said bullet cores and a plurality of anodes in alternating sequence in a circular pattern, thereby giving said bullet cores uniform electrical exposure to said anodes, said motorized agitator continuously reciprocating said carousel in clockwise and counterclockwise rotational movement during electroplating to give good agitation of the said plating bath during the electroplating process.

* * * * *